US011757196B2

(12) United States Patent
Bontzos et al.

(10) Patent No.: US 11,757,196 B2
(45) Date of Patent: Sep. 12, 2023

(54) ANTENNA ELORAN COMMUNICATION SYSTEM

(71) Applicant: Hellen Systems, Middleburg, VA (US)

(72) Inventors: Konstantinos Bontzos, Sykesville, MD (US); David Daniel, Winter Garden, FL (US); Paul Virgilio, Parkville, MD (US); John Young, Woodbine, MD (US)

(73) Assignee: Hellen Systems, Middleburg, VA (US)

( * ) Notice: Subject to any disclaimer, the term of this patent is extended or adjusted under 35 U.S.C. 154(b) by 49 days.

(21) Appl. No.: 17/545,483

(22) Filed: Dec. 8, 2021

(65) Prior Publication Data

US 2022/0190480 A1 Jun. 16, 2022

Related U.S. Application Data

(60) Provisional application No. 63/125,739, filed on Dec. 15, 2020.

(51) Int. Cl.
*H01Q 5/328* (2015.01)
*H01Q 9/42* (2006.01)

(52) U.S. Cl.
CPC ..... *H01Q 9/42* (2013.01); *H01Q 5/328* (2015.01)

(58) Field of Classification Search
CPC ..... H01Q 9/42; H01Q 5/328
See application file for complete search history.

(56) References Cited

U.S. PATENT DOCUMENTS

| | | | | |
|---|---|---|---|---|
| 6,337,666 | B1 * | 1/2002 | Bishop | H01Q 9/40 343/702 |
| 2001/0011964 | A1 * | 8/2001 | Sadler | H01Q 9/285 343/824 |
| 2006/0028383 | A1 | 2/2006 | Yoshino | |
| 2006/0044205 | A1 | 3/2006 | Lynch et al. | |
| 2007/0285324 | A1 | 12/2007 | Waterhouse et al. | |
| 2008/0074326 | A1 | 3/2008 | Huang et al. | |
| 2008/0094283 | A1 * | 4/2008 | Mei | H01Q 9/285 343/700 MS |
| 2008/0106473 | A1 | 5/2008 | Chung et al. | |
| 2017/0141472 | A1 | 5/2017 | Park et al. | |

OTHER PUBLICATIONS

International Search Report and Written Opinion dated Mar. 28, 2022 in corresponding PCT Application No. PCT/US2021/072894.

* cited by examiner

*Primary Examiner* — Hai V Tran
*Assistant Examiner* — Michael M Bouizza
(74) *Attorney, Agent, or Firm* — Harness, Dickey & Pierce, P.L.C.

(57) ABSTRACT

An antenna includes a dielectric substrate having a planar shape. The dielectric substrate has a first side and a second side. An elongated feed is disposed on the first side of the substrate. A ground plane is disposed adjacent to and spaced apart from the feed on the first side of the substrate. A meander has a first end coupled to the elongated feed. The meander comprises a second end disposed opposite the first end. A first extension extends from the second end adjacent to the meander. A second extension extends from the second end adjacent to the meander.

14 Claims, 5 Drawing Sheets

ANTENNA ELORAN COMMUNICATION SYSTEM

CROSS-REFERENCE TO RELATED APPLICATIONS

This application claims the benefit of U.S. Provisional Application No. 63/125,739, filed on Dec. 15, 2020. The entire disclosure of the above application is incorporated herein by reference herein.

FIELD

The present disclosure relates to an antenna for a communication system, and, more particularly to a receiving antenna for receiving an enhanced low frequency long range navigation system.

BACKGROUND

This section provides background information related to the present disclosure which is not necessarily prior art.

eLoran is a low-frequency radio navigation system that operates in the frequency band of 90 to 110 kHz. eLoran is built on internationally standardized Loran-C, and provides a high-power PNT service for use by all modes of transport and in other applications. eLoran is an independent dissimilar complement to GNSS. It allows GNSS users to retain the safety, security and economic benefits of GNSS even when their satellite services are disrupted. eLoran meets a set of worldwide standards and operates wholly independently of GPS, GLONASS, Galileo, or any future GNSS. Each eLoran receiver is operable in all regions where an eLoran service is provided. eLoran receivers work automatically, with minimal user input. The core eLoran system comprises modernized control centers, transmitting stations and monitoring sites. eLoran transmissions are synchronized to an identifiable, publicly-certified, source of Coordinated Universal Time (UTC) by a method wholly independent of GNSS. This allows the eLoran Service Provider to operate on a time scale that is synchronized with but operates independently of GNSS time scales. Synchronizing to a common time source also allows receivers to employ a mixture of eLoran and satellite signals. The principal difference between eLoran and traditional Loran-C is the addition of a data channel on the transmitted signal. This conveys application-specific corrections, warnings, and signal integrity information to the user's receiver. It is this data channel that allows eLoran to meet the very demanding requirements of landing aircraft using non-precision instrument approaches and bringing ships safely into harbor in low-visibility conditions. eLoran is also capable of providing the exceedingly precise time and frequency references needed by the telecommunications systems that carry voice and internet communications.

eLoran has many uses. Typically, an antenna for an eLoran system is rather bulky. However, a ship, airplane or other vehicle can incorporate such a device. A desirable application of the eLoran technology is in smaller devices. For example hand held devices or portable phones could benefit from the technology. However, the size of the antennas currently known make such implementation unmanageable or impossible.

SUMMARY

This section provides a general summary of the disclosure, and is not a comprehensive disclosure of its full scope or all of its features.

In one aspect of the disclosure, an antenna includes a dielectric substrate having a planar shape. The dielectric substrate has a first side and a second side. An elongated feed is disposed on the first side of the substrate. A ground plane is disposed adjacent to and spaced apart from the feed on the first side of the substrate. A meander has a first end coupled to the elongated feed. The meander comprises a second end disposed opposite the first end. A first extension extends from the second end adjacent to the meander. A second extension extends from the second end adjacent to the meander.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. The antenna may have various size features for the individual parts of the antenna. The antenna is used to receive eLoran signals, although other uses are not precluded.

Figure 1:
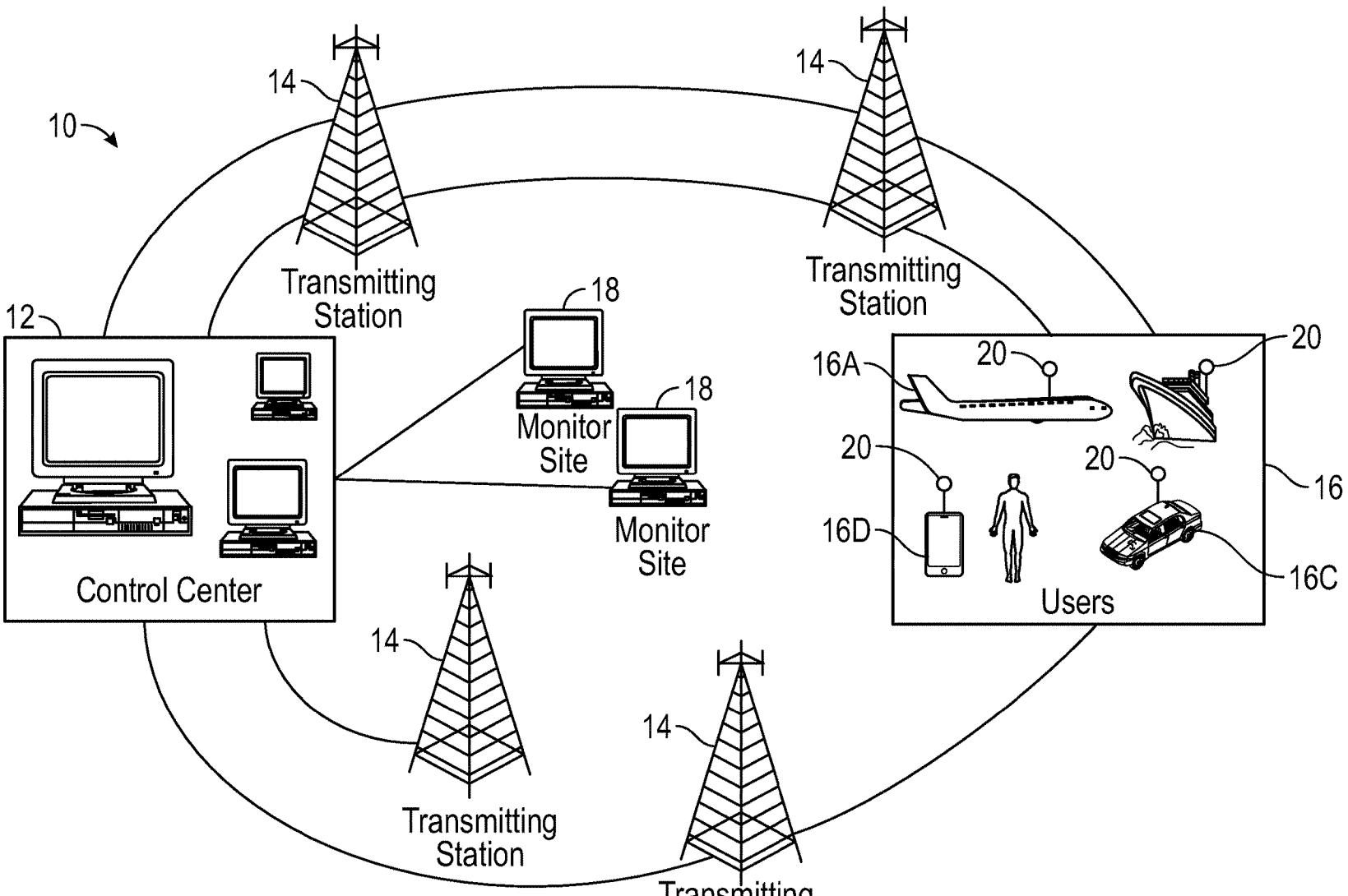
FIG. 1 is a diagrammatic view of an eLoran system according to the present disclosure.

Referring now to FIG. 1, a high level diagrammatic view of an eLoran communication system 10 is set forth. In general, eLoran signals travel over the surface of the earth and are subject to small propagation delays that depend on the electrical conductivity of the ground. A high level of accuracy is achieved by correcting for propagation delays.

The system includes a control center 12 that is in communication with a plurality of transmitting stations 14. The transmitting stations 14 transmit signals to the user devices 16. The control center 12 typically runs unattended with service personnel on call. Monitoring sites 18 act as receivers and provide real-time information to the control center 12 for detecting abnormalities. Feedback from the monitoring sites 18 may be used for providing differential corrections.

The transmitting stations transmit signals to different types of users. In this example, a user device 16 may be disposed in various vehicles or may be hand held type devices. As illustrated, an airplane 16A, a ship 16B, an automotive vehicle 16C and a portal device 16D may incorporate a receiving system. In this example, the portal device 16D is a cellular phone. An antenna 20 is used for receiving signals at the various devices. The signals received may be time signals and location signal. As well, a data channel is also established within the eLoran system. The data channel conveys corrections, warnings and signal integrity information to the receivers associated with the user devices 16.

Figure 2:
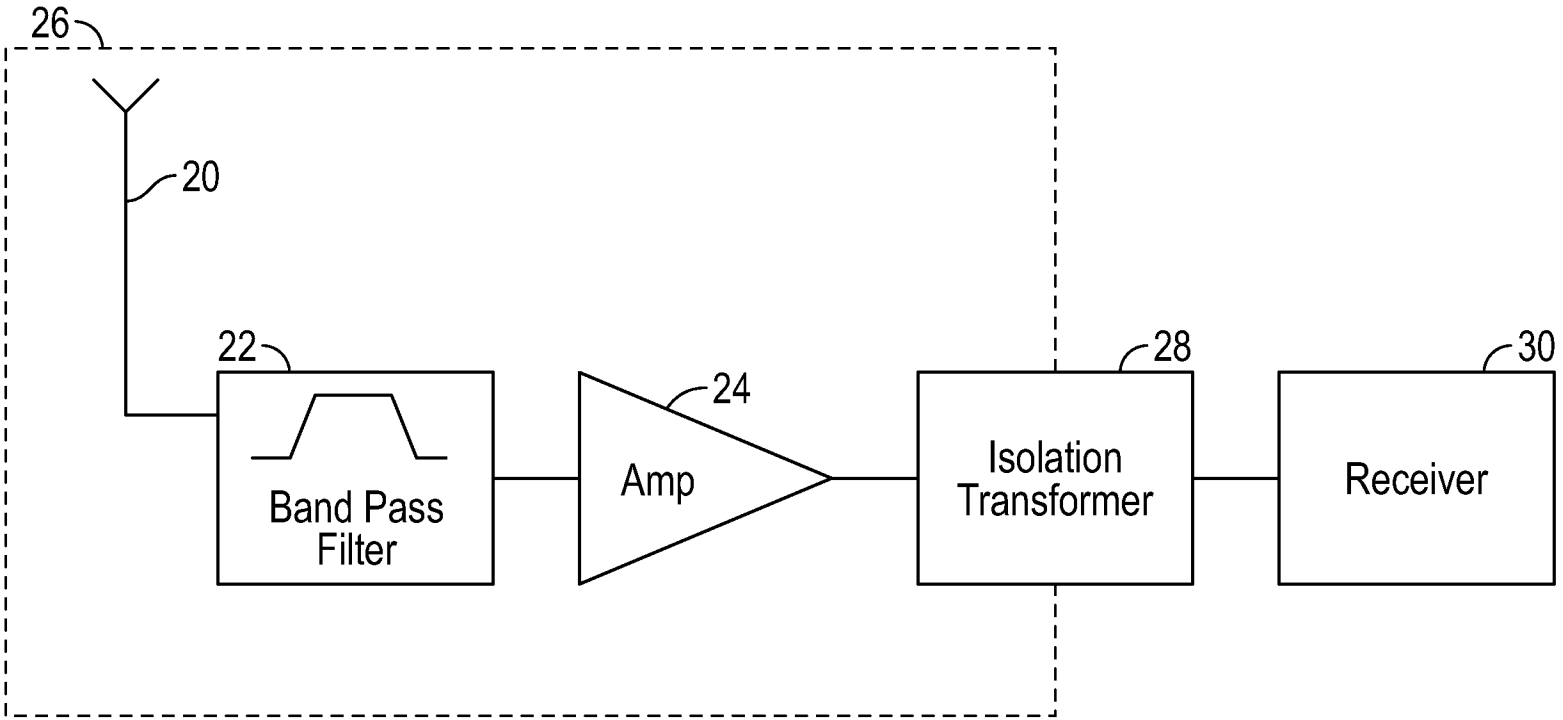
FIG. 2 is a block diagrammatic view of an antenna circuit.

Referring now to FIG. 2, the antenna 20 may be associated with a band pass filter 22 and an amplifier 24. The antenna 20, the band pass filter 22 and the amplifier 24 may be disposed on a substrate 26. The substrate 26 may be a dielectric substrate. However, the band pass filter 22 and the amplifier 24 may be disposed as separate components coupled between the antenna 20 and a receiver 30. Details of the antenna 20 are described in more detail below. The band pass filter 22 is used for filtering higher frequencies and lower frequencies than the band provided. In one example, a Chebyshev band pass filter is used. In an eLoran system, the center frequency is 100 kHz and the desirable frequencies are between 90 and 100 kHz to provide a total bandwidth of 20 kHz. Of course, for other systems, the band pass filter 22 may be tuned differently.

The amplifier 24 is used for amplifying the signal communicated from the band pass filter 22. In one example, a two stage amplifier using an LT6235 from Analog Devices Corp. was used. The LT6235 is a low noise, low power instrumentation amplifier. A second amplifier in series with the first amplifier was used. The LT1206 amplifier is a current feedback amplifier with high output current drive capability. However, various types of signal and multi-stage amplifiers may be used depending upon the signal received and the desired output characteristics. The receiver 30 receives the amplified signal from the amplifier 24. The receiver 30 processes the amplified signal to determine location, timing and other data therefrom.

An isolation transformer 28 may be coupled to the substrate 26 or to the receiver 30 or both. The isolation transformer filters additional noise from the received signal. It was found that the isolation transformer 28 allows lower level signals to be discerned from the received signal.

Figure 3A:
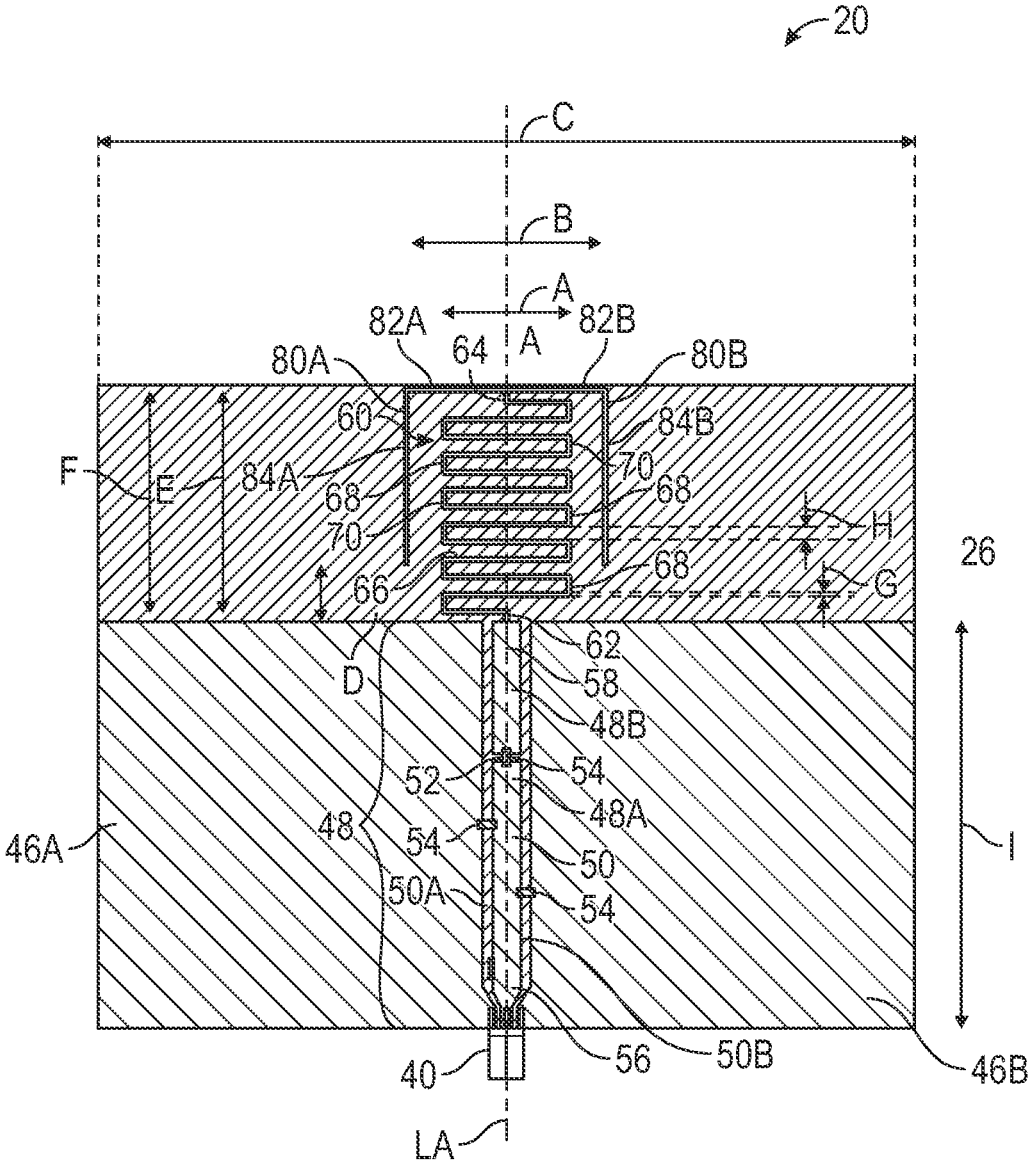
FIG. 3A is a schematic view of an antenna.
Figure 3B:
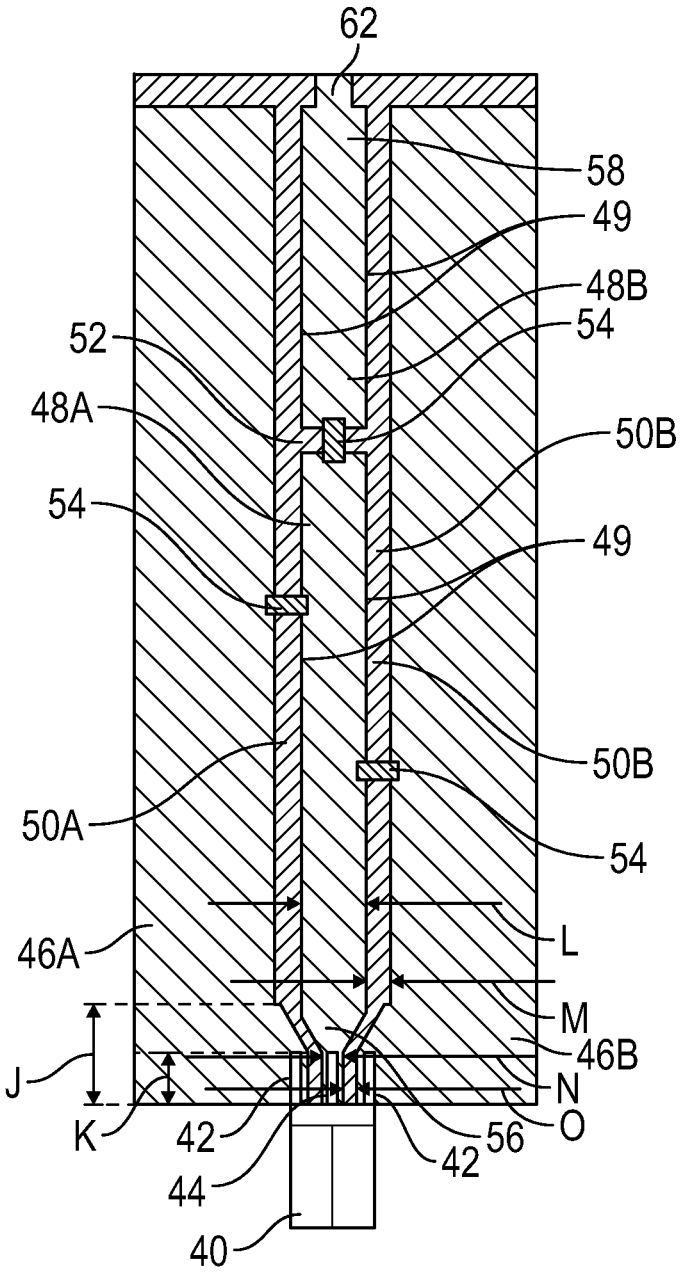
FIG. 3B is an enlarged view of the ground plane portion in feed of the antenna of FIG. 3A.

Referring now to FIGS. 3A and 3B, the antenna 20 is illustrated on a substrate 26. In this example, the substrate 26 contains only the antenna 20 and the circuitry such as the band pass filter 22, the amplifier 24 and the isolation transformer 28. In this example, the antenna 20 is formed from a planar outer conductive layer of a circuit board. A connector 40 is coupled to the circuit board. The connector 40 illustrated as a subminiature version A (SMA) connector. The SMA connector 40 is a semi-precision coaxial RF connector. The connector 40 has an outer portion 42 and an inner portion 44. The outer portion 42 is coupled to a ground plane 46 that has two ground plane portions 46A, 46B. The ground plane 46A, 46B are electrically in communication through the outer portions 42. The ground planes 46A, 46B are disposed laterally relative to an elongated feed 48. The feed 48 has two elongated sides 49 adjacent to and spaced apart from the first ground plane 46A and the second ground plane 46B by gaps 50A and 50B in the electrically conductive layer of the substrate 26. Gaps 50A, 50B are used to separate the ground plane 46A from the feed 48 while gap 50B is used to space the ground plane 46B from the feed 48. In this example, the feed 48 comprises a first feed portion 48A and a second feed portion 48B that are spaced apart by a gap 52 in the conductive layer of the substrate 26.

Coupling components 54 may be disposed over the gaps 50A, 50B and 52. That is, the coupling components 54 may be a combination of one or more electrical components. For example, a capacitor, a very high resistance resistor, such as a one megohm and diodes may be used as the coupling components. The coupling components may be also be an inductor. The size of the components, for example, the capacitance, the resistance, the inductance or the type of diode varies depending upon the characteristics of the received signal.

The antenna 20 has a longitudinal axis LA that extends through the connector and through the feed portions 48A, 48B. The longitudinal sides 49 of the feeds 48A, 48B including the gaps 50A, 50B are parallel to the longitudinal axis LA. In this example, the first end 56 of the feed 48 is triangular or angled and is coupled to the inner portion 44 of the connector 40. A second end 58 of the feed 48 is coupled to a meander 60. The meander 60 has a first end 62 coupled to the second end 58 of the feed 48. The meander 60 has a second end 64 that may be referred to as a common node as will be described in further detail below. The meander 60 has a longitudinal length between the first end 62 and the second end 64, which, in this example, is less than the longitudinal length of the feed. The meander 60 has a plurality of turns 70 that are formed from a plurality of lateral portions 66 and a plurality of longitudinal portions 68 that space out the lateral portions 66 in the longitudinal direction. The lateral portions 66 and the longitudinal portions 68 form right angles. The longitudinal portions 68, except the first and last longitudinal portions, extend symmetrically on each side of the longitudinal axis LA and have a length longer than the combination of the feed 48 and the gaps 50A, 50B. The number of turns 70 formed by the lateral portions 66 and the longitudinal portions 68 increase the efficiency. In this example, the number of turns 70 is twelve. However, at least 10 turns may be used. The resonant frequency of the meander 60 decreases as the length of the longitudinal portions 68 increase. Thus, the size of the meander 60 varies depending upon the characteristics of the signal to be received. The meander 60 is elongated and the total length of the lateral portions 66 is longer than the longitudinal portions 68.

The second end 64 is coupled to a first extension 80A and a second extension 80B. In this example, the first extension 80A comprises a first lateral portion 82A and the second extension 80B comprises a second lateral portion 82B. The lateral portions 82A, 82B extend laterally wider than the longitudinal portions of the turns 70 of the meander 60. The first extension 80A also has a longitudinal portion 84A extending longitudinally from the lateral portion 80A. The second extension 80B has a longitudinal portion 84B extending longitudinally from the lateral portion 82B. The longitudinal portion 84A, 84B are parallel to the longitudinal axis, in this example. The lateral portion 82A forms a right angle with the longitudinal portion 84A. The lateral portion 82B forms a right angle with the longitudinal portion 84B. Longitudinal portion 84A extends toward the ground plane 46A. The longitudinal portion 84B extends toward the ground plane 46B.

Figure 4A:
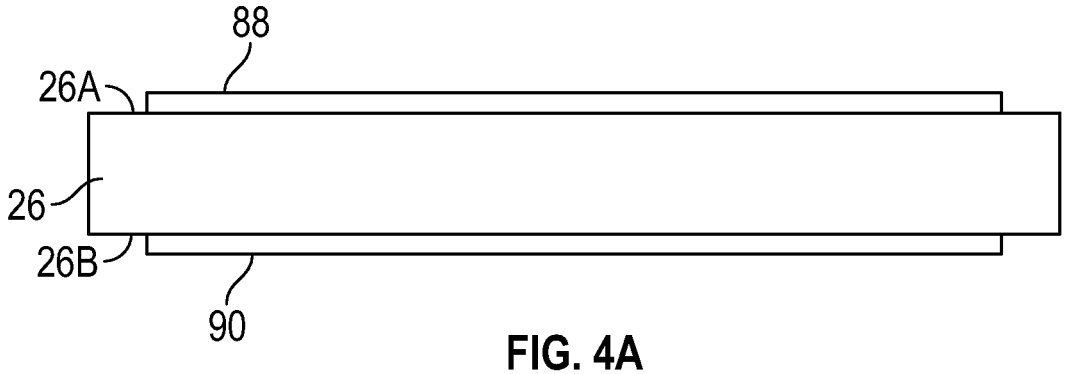
FIG. 4A is a cross-sectional view of the antenna in a first example.
Figure 4B:
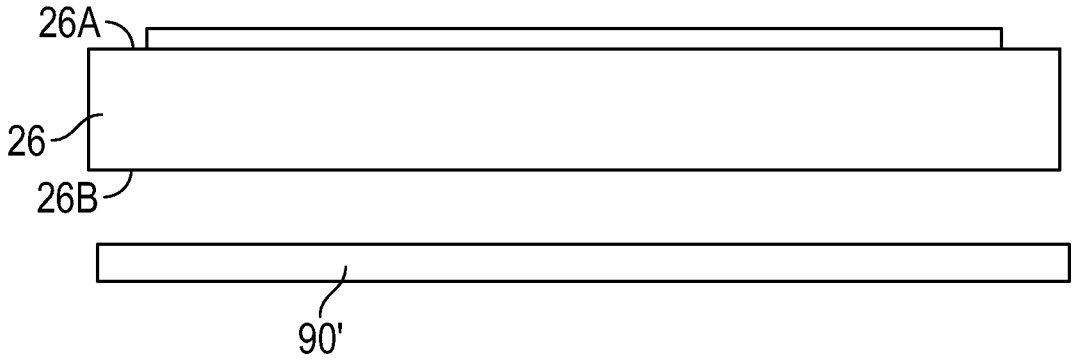
FIG. 4B is a cross-sectional view of the antenna relative to an external ground plane in a second example.

Referring now also to FIGS. 4A and 4B, the substrate 26 has a first side 26A and a second side 26B. The first side 26A has the components 88 illustrated in FIG. 3A, namely the ground plane 46A, 46B, the components of the meander 60 and the extensions 80A, 80B and its components making them coplanar. The ground plane 46 does not extend opposite the meander 60 of the substrate 26. The first side components 88 generally refer to the components described above on the first side 26A of the substrate 26. To improve the reception, a second ground plane 90 may be disposed on the second side 26B of the substrate 26. The ground plane 90 may extend under the ground plane 46 and under the meander 60 and the first extension and the second extension 80A, 80B. However, the ground plane 90 is optional. It should be noted that the components 88 may be etched from the circuit board. That is, the substrate 26 may include a first metal side and a second metal side separate by a dielectric. The dielectric may be exposed in areas by cutting or chemically etching so that the components forming the meander are formed. The components forming the meander 60 may be referred to as a circuit trace. Likewise, the gaps 50A, 50B and 52 may be formed in a similar manner by etching or chemical removal. Another process for forming the antenna 20 is three dimensional printing.

Referring now to FIG. 4B, the ground plane 90' is separated from the second side of the substrate 26B. That is, the ground plane 90' may not be formed as part of the substrate 26 but rather a separate component or a component of the vehicle or device that is it mounted. For example, the ground plane 90' may be the outer skin of a ship, airplane or car.

In the present example, a center frequency of 100 kHz is used with a 20 kHz bandwidth. The size of the various components used in one constructed embodiment are as follows: the length A of the lateral portions 66 was 23.93 mm. The length B of the lateral spacing between the longitudinal portions 84A, 84B was 37.96 mm. The length C corresponding to the lateral extent of the ground plane 46 was 6 in. The length D corresponding to the distance between the end of the longitudinal portions 84A, 84B of the first extension 80A and the second extension 80B was 10.725 mm. The length E corresponding to the distance between the ground plane and the lateral portions 82A, 82B was 43.73 mm. The length F between the furthest extent of the lateral portions 82A, 82B to the ground plane 46 is 1.75 in. The length G corresponds to the thickness of the meanders is 0.838 mm. The length H corresponding to the distance between two adjacent lateral portions of the meander is 2.46 mm. The length I corresponds to the longitudinal distance of the feed 48 and the length longitudinally of the ground plane 46. The length J corresponding to the distance from the angle to the connector 40 is 7.5 mm. The length K corresponding to the distance from the end of the terminals 42 to the connector 40 is 3.8 mm. The length L corresponding to the width of the feed 48 is 5 mm. The gap between the feed and each ground plane 46A, 46B is 0.676 in. The width end corresponding to the width of the end of the feed is 1.78 mm. The length O of the gap between the first end 56 of the feed 48 and the ground planes 46A and 46B is 1 mm.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna comprising:

a dielectric substrate having a planar shape, said dielectric substrate comprising a first side and a second side;

an elongated feed disposed on the first side of the substrate, said elongated feed comprising a first longitudinally extending side and a second longitudinally extending side, said elongated feed comprising a first portion spaced apart from a second portion by a coupling component;

a ground plane disposed adjacent to and spaced apart from the feed on the first side of the substrate, wherein the ground plane comprises a first portion adjacent to and spaced apart from the first longitudinally extending side and a second portion adjacent to and spaced apart from the second longitudinally extending side;

a meander having a first end coupled to the elongated feed, said meander comprising a second end disposed opposite the first end, wherein the elongated feed and the meander are coaxial about a longitudinal axis, wherein the second end extends longitudinally, is coaxial with longitudinal axis and forms a common node;

a first extension extending from the second end adjacent to the meander at the common node, said first extension comprises a first lateral portion extending from the second end and a first longitudinal portion extending from the first lateral portion and disposed adjacent to the meander; and a second extension extending from the second end adjacent to the meander at the common node, said second extension comprises a second lateral portion extending from the second end and a second longitudinal portion extending from the second lateral portion and disposed adjacent to the meander on an opposite side of the meander from the first longitudinal portion, wherein the first extension and the second extension are symmetrical about the longitudinal axis.

2. The antenna of claim 1 wherein the first longitudinal portion and the second longitudinal portion are parallel.

3. The antenna of claim 1 wherein the first longitudinal portion and the second longitudinal portion extend longitudinally toward the ground plane.

4. The antenna of claim 1 wherein a length of the first longitudinal portion is less than a longitudinal length of the meander.

5. The antenna of claim 1 wherein a longitudinal length of the meander is less than a longitudinal length of the feed.

6. The antenna of claim 1 wherein a width of the meander is greater than the width of the feed.

7. The antenna of claim 1 wherein the meander comprises a plurality of turns.

8. The antenna of claim 7 wherein the plurality of turns is greater than 10.

9. The antenna of claim 1 further comprising a first gap between the ground plane and feed.

10. The antenna of claim 1 further comprising a connector electrically coupled to the feed and the ground plane.

11. The antenna of claim 1 wherein the feed and the ground plane are coplanar.

12. The antenna of claim 1 wherein the feed, the ground plane, the meander, the first extension and the second extension are coplanar.

13. The antenna of claim 1 further comprising a second ground plane disposed on the second side of the substrate.

14. A system comprising the antenna recited in claim 1;

a band pass filter; and an amplifier.

* * * * *